US005760751A

United States Patent [19]

Gipson

[11] Patent Number: 5,760,751

[45] Date of Patent: Jun. 2, 1998

[54] PORTABLE SATELLITE ANTENNA MOUNT

[76] Inventor: Richard L. Gipson, 4450 Ireland Dr., Owensboro, Ky. 42303

[21] Appl. No.: 366,473

[22] Filed: Dec. 30, 1994

[51] Int. Cl.[6] ..... H01Q 1/12

[52] U.S. Cl. ..... 343/880; 343/878; 343/890; 248/529; 248/910

[58] Field of Search ..... 343/880, 878, 343/840, 882, 881, 890; 248/523, 524, 529, 910; H01Q 1/12

[56] References Cited

U.S. PATENT DOCUMENTS

| | | | |
|---|---|---|---|
| 3,646,564 | 2/1972 | Drislane | 343/881 |
| 4,649,675 | 3/1987 | Moldovan et al. | 343/878 |
| 4,771,293 | 9/1988 | Williams et al. | 343/881 |
| 4,868,578 | 9/1989 | Bruinsma et al. | 343/882 |
| 5,019,833 | 5/1991 | Nonaka | 343/840 |
| 5,088,680 | 2/1992 | Farmer | 248/910 |
| 5,142,293 | 8/1992 | Ross | 343/840 |
| 5,158,281 | 10/1992 | Williams | 273/1.5 R |
| 5,207,406 | 5/1993 | Stine et al. | 248/514 |
| 5,220,740 | 6/1993 | Brault | 248/910 |
| 5,390,914 | 2/1995 | Schroeder | 248/910 |

FOREIGN PATENT DOCUMENTS

| | | | |
|---|---|---|---|
| 56-129408 | 10/1981 | Japan | 343/840 |
| 60-89102 | 5/1985 | Japan | 343/840 |

*Primary Examiner*—Michael C. Wimer
*Attorney, Agent, or Firm*—Richard C. Litman

[57] ABSTRACT

A portable mount for a satellite dish antenna. The mount is comprised of a hollow base designed be to filled with liquid ballast. The top surface of the base contains an indentation for receiving an antenna support mounting bracket and a second, connected indentation for receiving an antenna support when not in use. When in use the base is filled with ballast material, the antenna support is rotated to a generally vertical position, and a satellite dish is attached. When in transport, the ballast is emptied, the satellite dish is removed, and the support is rotated into its indentation in the base. The base is generally rectangular, with a handle formed therein.

1 Claim, 2 Drawing Sheets

PORTABLE SATELLITE ANTENNA MOUNT

BACKGROUND OF THE INVENTION

1. Field of the Invention

The present invention relates to mounts for satellite antenna support, and more particularly to portable ballasted mounts to be used with small antennas for satellite TV systems.

2. Description of the Prior Art

Many supports for satellite antennas have been devised. As the number of satellite communications systems has grown so has the variety of antennas and mounts used to support them. An important advantage for antenna support mounts is portability and adjustability so that the antenna may be properly aligned at any location. Some methods for achieving these goals are disclosed in the following patents.

U.S. Pat. No. 4,649,675, issued to Nicholas Moldovan et al. on Mar. 17, 1987, discloses a ballasted roof mount for an antenna which may be disassembled and moved.

U.S. Pat. No. 4,868,578 issued to Robert F. Bruinsma et al. on Sep. 19, 1989, discloses a portable antenna assembly which is driven into the ground for support.

U.S. Pat. No. 5,019,833 issued to Yasuyuki Nonaka on May 28, 1991, discloses a portable antenna formed from the exterior of a housing designed to receive equipment such as a satellite signal converter.

U.S. Pat. No. 5,142,293 issued to David J. Ross on Aug. 25, 1992, discloses a hinged ballasted roof mount for a satellite antenna. The mount is designed to be placed over the crown of a roof.

U.S. Pat. No. 5,158,281 issued to Linkwood Williams on Oct. 27, 1992, discloses a portable liquid filled mount for a basketball goal assembly.

U.S. Pat. No. 5,207,406 issued to Janice A. Stine et al. on May 4, 1993, discloses a portable ballasted umbrella stand.

Japanese Patent No. 56-129408 issued to Akihiro Kurose on Oct. 9, 1980, discloses an adjustable antenna mount.

Japanese Patent No. 60-89102 issued to Masashige Hiramatsu on May 20, 1985, discloses an antenna support which is ballasted.

None of the above inventions and patents, taken either singly or in combination, is seen to describe the instant invention as claimed.

SUMMARY OF THE INVENTION

According to the present invention, a small portable mount support for a satellite antenna is provided. The mount is designed to be used with small satellite antennas designed for cooperation with consumer subscription satellite TV systems. Mounts for these antennas are traditionally designed to be permanently attached to a fixed location such as a house.

Accordingly, it is a principal object of the invention to provide a base which has enough mass to support a satellite antenna and its mount, and yet is light enough to be easily carried.

It is another object of the invention to provide a convenient means for transporting a satellite antenna support and mount.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
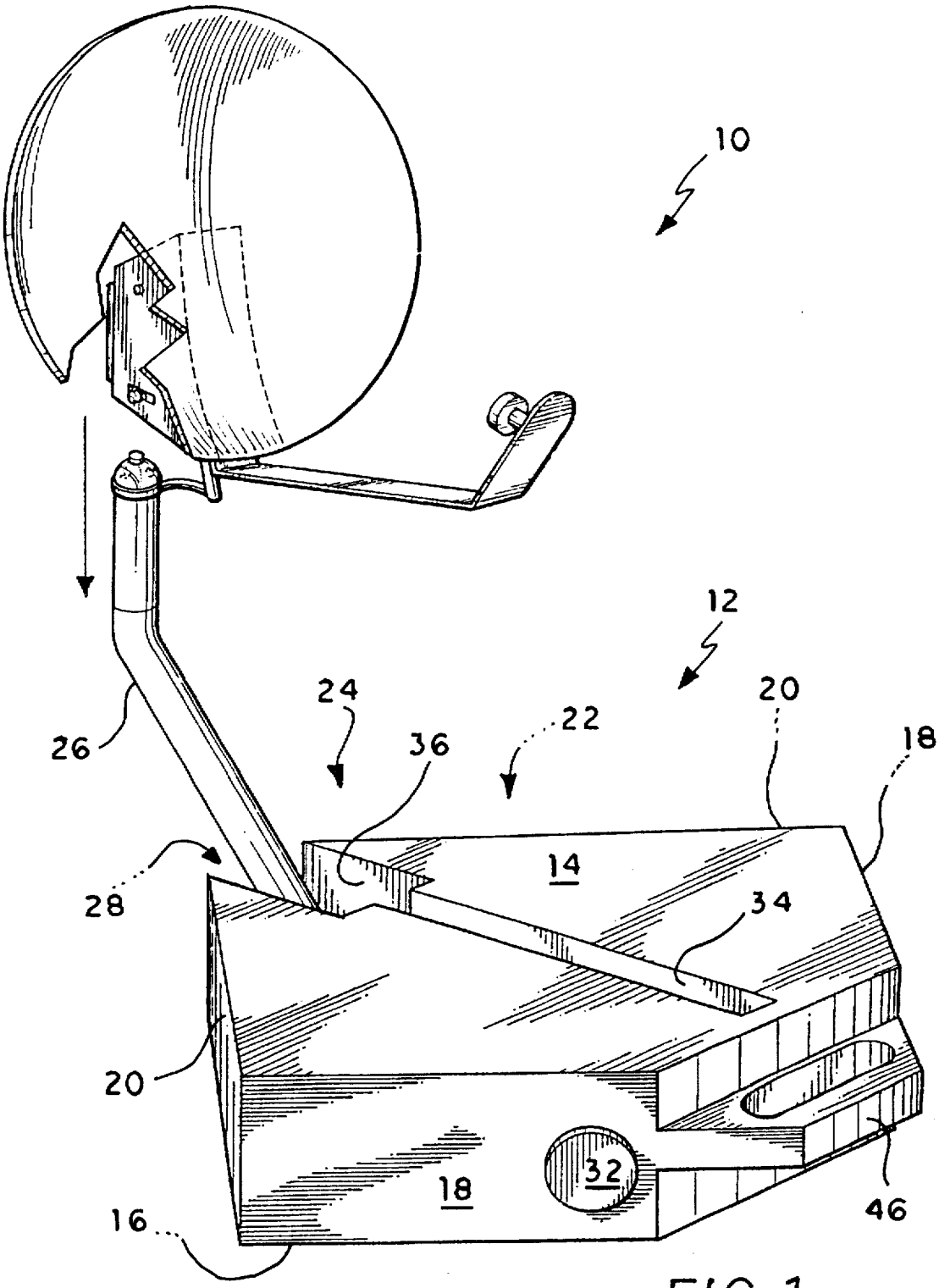
FIG. 1 is a perspective view of the portable satellite antenna mounting apparatus, parts being broken away to reveal interior detail.
Figure 2:
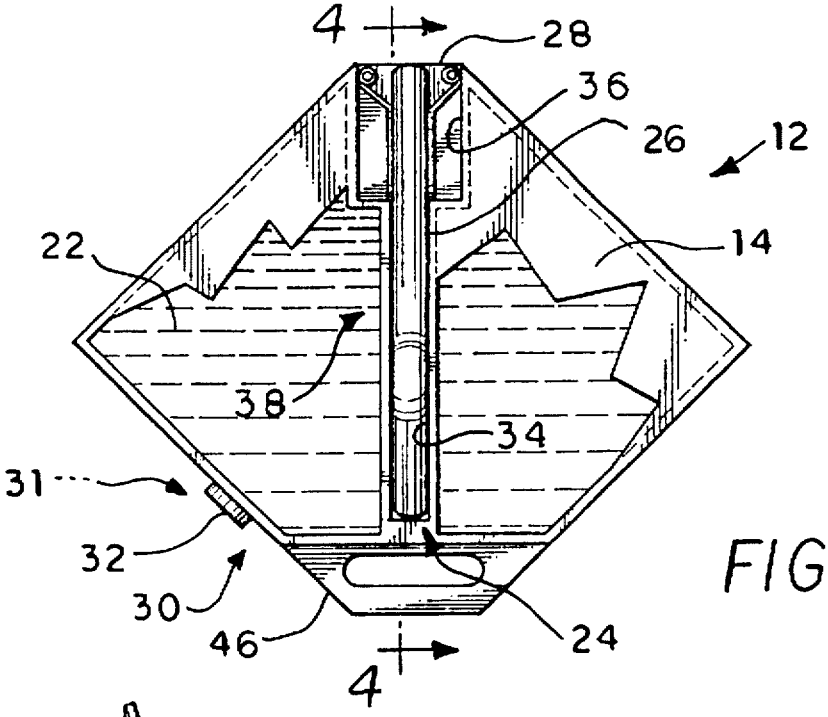
FIG. 2 is a top view of the portable satellite antenna mounting apparatus, with parts broken away to reveal internal structure, and showing the antenna support in a stowed position and a ballast material in a hollow container forming a base for the portable satellite antenna mounting apparatus.
Figure 3:
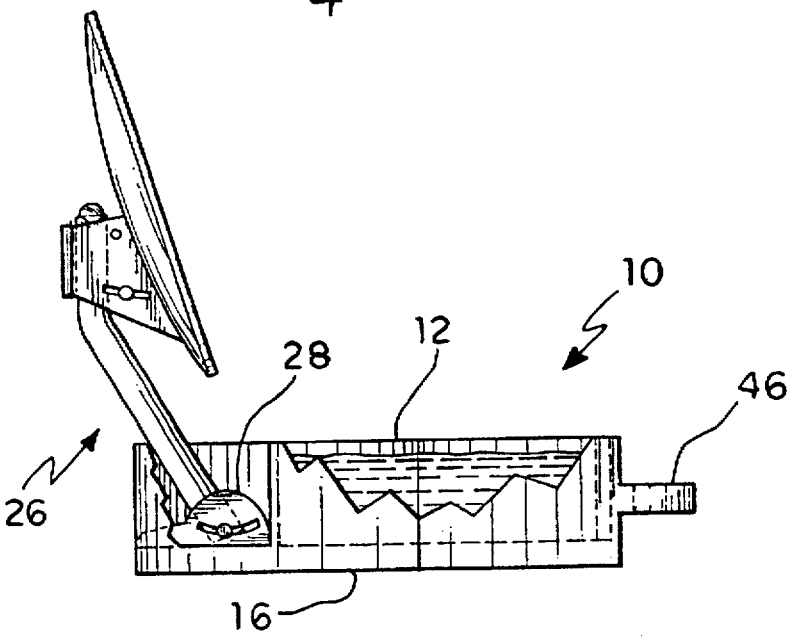
FIG. 3 is a side elevational view of the satellite antenna mounting apparatus, again with parts broken away to reveal internal details, and showing the antenna support in a deployed position, and the antenna attached to the antenna support.

The present invention, as shown in FIGS. 1 and 2, is a portable satellite antenna mounting apparatus 10. The portable satellite antenna mounting apparatus 10 comprises a hollow container 12. The hollow container 12 has a top surface 14, a bottom surface 16, and sides 18, 20. The hollow container 12 may be selectively filled with ballast material 22. An indentation 24 may be formed in the top surface 14 of the hollow container 12. The indentation 24 is shaped to contain both an antenna support 26 and bracket 28 for connecting the antenna support 26 to said hollow container 12, as shown in FIG. 3.

Referring to FIG. 2, the hollow container 12 is preferably watertight and includes an opening 30. The opening 30 has a lip 31 on which a cap 32 is removably attached. The hollow container 12 is selectively filled with a ballast material 22, such as water or sand, through the opening 30 until a desired mass is contained within the hollow container 12. Conversely, prior to transporting the portable satellite antenna assembly 10, the ballast material 22 may be drained from the hollow container 12 through the opening 30. An opening ranging from 1 to 1-½ inches in diameter is sufficient for efficiently filling and emptying the hollow container 12.

A hollow container having dimensions approximating 20 inches by 20 inches, and being about five inches high, provides roughly a six gallon reservoir. Such a such a reservoir should be sufficient for retaining a desired mass. Furthermore, a hollow container 12 formed from a resilient plastic material and ranging between 0.0080 and 0.0160 inch thick is sufficiently strong enough to support the desired mass contained therein. A hollow container formed according to the specifications above would weight less than five pounds when empty and between 45 and 55 pounds when full of water.

Figure 4:
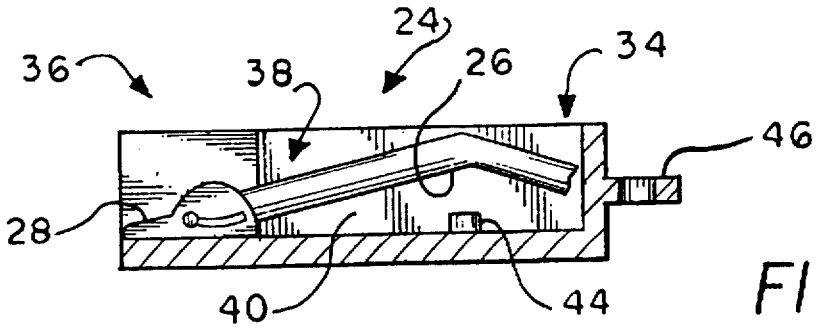
FIG. 4 is a sectional view of the portable satellite antenna mounting apparatus taken along line 4—4 of FIG. 2.

As shown in FIGS. 2 and 4, the indentation 24 includes a substantially long and narrow portion 34 shaped to contain the antenna support 26, and a wider portion 36 shaped to contain the bracket 28 which connects the antenna support 26 to the hollow container 12. The antenna support 26 consists essentially of a pole 38 having a lower end which is pivotally engageable with the bracket 28.

The long and narrow portion 34 of the indentation 24 defines an area 40, as shown in FIG. 4, for storing accessories for use with the satellite antenna 42 and antenna support 26. The accessories include, for example, a compass 44 which is supported by the pole 38 of the antenna support 26. The compass 44 identifies the position of the portable satellite antenna mounting apparatus 10 relative to the earth's poles, i.e., positioned so as to view south. The compass 44 includes a water bubble level having indicia identifying its center, e.g., a red dot, and a water bubble. To position the pole 38 of the antenna support 26 vertically, as shown in FIG. 3, center the water bubble with the red dot.

Referring to FIG. 2, the top surface 14 is preferably formed from a resilient material and the long and narrow portion 34 of the indentation 24 is preferably slightly smaller than the antenna support 26 it is meant to contain. When the antenna support 26 is forced into the long and narrow portion 34 of the indentation 24, the resilient material will allow the indentation 24 to grip the antenna support 26.

As shown in FIG. 3, the antenna support 26 is displaced to a deployed position and the antenna is attached to the antenna support 26. The antenna support 26 is pivotally supported by the bracket 28. The bracket 28 is, in turn, is rigidly attached to the hollow container 12, such as by being bolted to the hollow container 12 as is shown in the drawing. It is preferable that the antenna support 26 be selectively fixed relative to the bracket 28, thus providing stability for the antenna support 26. In addition, the bottom surface 16 is preferably flat. This further increases the stability of the antenna support 26.

A handle 46 may be formed on an outside surface 48 of the hollow container 12. The handle 46 enables the portable satellite antenna mounting apparatus 10 to be transported with ease.

Although the portable satellite antenna mounting apparatus as shown and described supports a DSS Dish for use with a 4699 Receiver Box, both manufactured by RCA, it may be structured to support various other antenna configurations.

Additionally, it is to be understood that the present invention is not limited to the sole embodiment described above, but encompasses any and all embodiments within the scope of the following claims.

I claim:

1. An antenna mounting apparatus for mounting a portable satellite antenna, said antenna mounting apparatus comprising:

a watertight hollow container having a width and including, a top surface formed from a resilient material, a flat bottom surface for providing a stable base, sides, a handle formed integrally with said hollow container, means defining an opening in said hollow container for admitting ballast material, said opening having a lip formed thereon, and a cap removably engageable with said lip;

a pole having an upper end for supporting a portable satellite antenna and a lower end;

a bracket connected to the lower end of said pole and secured to said top surface, said bracket pivoting said pole to a stowed position and a deployed position, an indentation cavity formed centrally in said top surface, said indentation cavity extending substantially along the width of said container and including a substantially long and narrow portion shaped to resiliently grip and wholly retain said pole when in the stowed position, and a relatively wider portion shaped to contain said bracket.

* * * * *